US006116849A

United States Patent [19]

Fesmire et al.

[11] Patent Number: 6,116,849

[45] Date of Patent: Sep. 12, 2000

[54] SHUTTLE HOPPER SYSTEM FOR LOADING AND UNLOADING COMMERCIAL WASHING AND DRYING MACHINES

[75] Inventors: Robert H Fesmire, Lake Forest; John Broadbent, Bloomingdale, both of Ill.

[73] Assignee: Ellis Corporation, Itasca, Ill.

[21] Appl. No.: 09/451,523

[22] Filed: Nov. 30, 1999

Related U.S. Application Data

[62] Division of application No. 09/037,691, Mar. 10, 1998, Pat. No. 5,992,186.

[51] Int. Cl.[7] ..... D06F 39/00

[52] U.S. Cl. ..... 414/800; 68/210; 414/13

[58] Field of Search ..... 414/800, 13, 421, 414/425; 68/210; 34/236

[56] References Cited

U.S. PATENT DOCUMENTS

| | | | |
|---|---|---|---|
| 2,282,583 | 5/1942 | Henrici | 68/210 X |
| 3,357,213 | 12/1967 | Herbertz | 68/210 |
| 3,712,090 | 1/1973 | Toth et al. | 68/210 |
| 3,742,738 | 7/1973 | Frotriede | 68/210 |

FOREIGN PATENT DOCUMENTS

| | | | |
|---|---|---|---|
| 123367 | 5/1960 | France | 414/13 |
| 2522116 | 11/1976 | Germany | 68/210 |

*Primary Examiner*—Philip R. Coe
*Attorney, Agent, or Firm*—Leydig, Voit & Mayer, Ltd

[57] ABSTRACT

A shuttle hopper system for loading and unloading commercial washers and dryers is provided. The shuttle hopper is equipped with a bucket for receiving laundry items and further includes lift and tilt assemblies which lift and rotate the bucket into a dumping position for discharging the laundry items into either a washer or a dryer. The shuttle hopper is adapted to move between at least one washer and one dryer such that the shuttle hopper can be utilized to transfer wet laundry items from the washer to the dryer. The shuttle hopper also may include a pulling fin assembly which selectively deploys a plurality of pulling fins in the shuttle bucket. The pulling fins are operable to move the laundry items contained within the shuttle bucket so as to facilitate the loading of items into the bucket and the discharge of items from the bucket.

2 Claims, 9 Drawing Sheets

SHUTTLE HOPPER SYSTEM FOR LOADING AND UNLOADING COMMERCIAL WASHING AND DRYING MACHINES

This is a divisional of application Ser. No. 09/037,691, filed on Mar. 10, 1998, and now U.S. Pat. No. 5,992,186.

FIELD OF THE INVENTION

The present invention relates generally to commercial washing and drying machines, and more particularly, to a method and apparatus for loading and unloading launderable items from such machines.

BACKGROUND OF THE INVENTION

Commercial laundry facilities must have the capacity to wash and dry large quantities of items. Accordingly, a commercial laundry facility typically includes a plurality of relatively expensive commercial sized (e.g., 450 lb. capacity) washing machines and dryers. Apart from the actual washing and drying operations, a substantial amount of time is consumed loading and unloading the large quantity of items to be laundered into and out of the washing machines. As will be appreciated, the time consumed in the loading and unloading operations restricts the amount of time the washers and dryers are actually operating. Thus, the time associated with loading and unloading the washers and dryers has a significant impact on the operational efficiency of a commercial laundry facility. Moreover, in order for a laundry facility to achieve a given laundering capacity, additional washers and dryers may be required as compared to what would be required if the washing machines could be loaded and unloaded more quickly and efficiently. Accordingly, reducing the time consumed in the loading and unloading operations could even allow a laundry facility to achieve a given laundering capacity with fewer washers and dryers thereby reducing operating and capital costs.

For example, one method of loading commercial washers and dryers, has involved transporting bag-like slings containing launderable items along an overhead sling conveyance system utilizing a monorail to a position above the washing machine and then unloading the sling to drop the launderable items into the washing machine. Once the washing operation is completed, the now laundered items in the washing machine are discharged into a sling, generally supported within a cart or container, which is then lifted to a position above the dryer where the items are discharged into the dryer. After the items have been dried they are again directed into a sling for subsequent transport and handling.

This type of system has numerous disadvantages. For example, since an operator must direct the movement and operation of the slings, such a procedure is very labor intensive and difficult to automate. In addition, complications often arise in the loading of the washers and dryers because the bag-like sling is rocking from its overhead support. In these situations, the sling must be steadied before the items can be discharged into the washer or dryer thereby further slowing the loading process. The overhead sling conveyance system is also relatively expensive. Moreover, the slings conventionally are adapted to contain only 200 to 225 pounds of launderable items. Thus, for the typical 450, 650 or 900 pound washing machine and dryer, using slings necessitates that the loading operation be carried out in two, three or four separate steps, thereby further increasing the loading cycle and the downtime for the washer and/or dryer.

While efforts have been made to shorten the loading and unloading cycles for commercial washers and dryers, prior proposals have introduced additional operating problems and have necessitated relatively complex and costly equipment. For example, attempts have been made to automatically discharge the contents of the washer onto a conveyer interposed between the washer and dryer following the completion of the washing cycle. In order to make room for the items as they are discharged or unloaded from the washing machine, the conveyor must be operated to transfer the washed items away from the washing machine. To allow relatively large loads to be discharged onto the conveyor, however, it is necessary that the conveyor be relatively long such as 10 to 18 feet. If the conveyor is not sufficiently long, the items will accumulate or pile up on the conveyor just below the washing machine, preventing the discharge of additional items. Accordingly, relatively wide spacing between the washer and dryer is required resulting in wasteful utilization of valuable floor space in the commercial laundering facility. Additionally, relatively long items, such as for example walk-off mats, can be spun right off the conveyor as they are discharged from the washer. Once the contents of the washing machine have been discharged onto the conveyor, the entire conveyor must then be indexed to a location adjacent the dryer. Loading the laundered items from the conveyor into the dryer generally necessitates moving the entire conveyor assembly first in one direction to a position in alignment with the dryer, and then, because the dryer has been tilted in an upward direction for receiving the laundered items, in a direction toward the dryer. Once these two movements have been executed, the conveyor is operated to move the items contained on the conveyor into the dryer. Since movement in two different directions is required, such an indexable belt conveyor, is relatively complex. Moreover, because the items received onto the conveyor are wet, they are relatively heavy, which can impede reliable movement of the conveyor belt. Moreover, as the dryer is loaded, bulky items can become trapped between the conveyor and the dryer. It can also be difficult to move the laundered items along the conveyor belt without some items accidentally falling to the side. Thus, systems using such belt conveyors are difficult to fully automate.

OBJECTS AND SUMMARY OF THE INVENTION

Accordingly, in view of the foregoing, it is a general object of the present invention to provide a commercial laundry facility with a washer and dryer loading and unloading system adapted for more quickly loading and unloading of launderable items from the washer and dryer, hence enabling more efficient operating utilization of such equipment.

Another object is to provide a commercial washer and dryer loading and unloading system of the foregoing type which is relatively compact in design and necessitates minimum floor space in the laundry facility.

A further object is to provide such a loading and unloading system that is relatively simple in design and is adapted for more efficient and reliable operation including more reliable and controlled movement of loads.

Still another object is to provide a method and apparatus as characterized above which does not require overhead monorails or the like.

Yet another object of the present invention is to provide a system of the foregoing type which permits the loading and unloading of the washers and dryers to be automated.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figures 1, 2, 3:
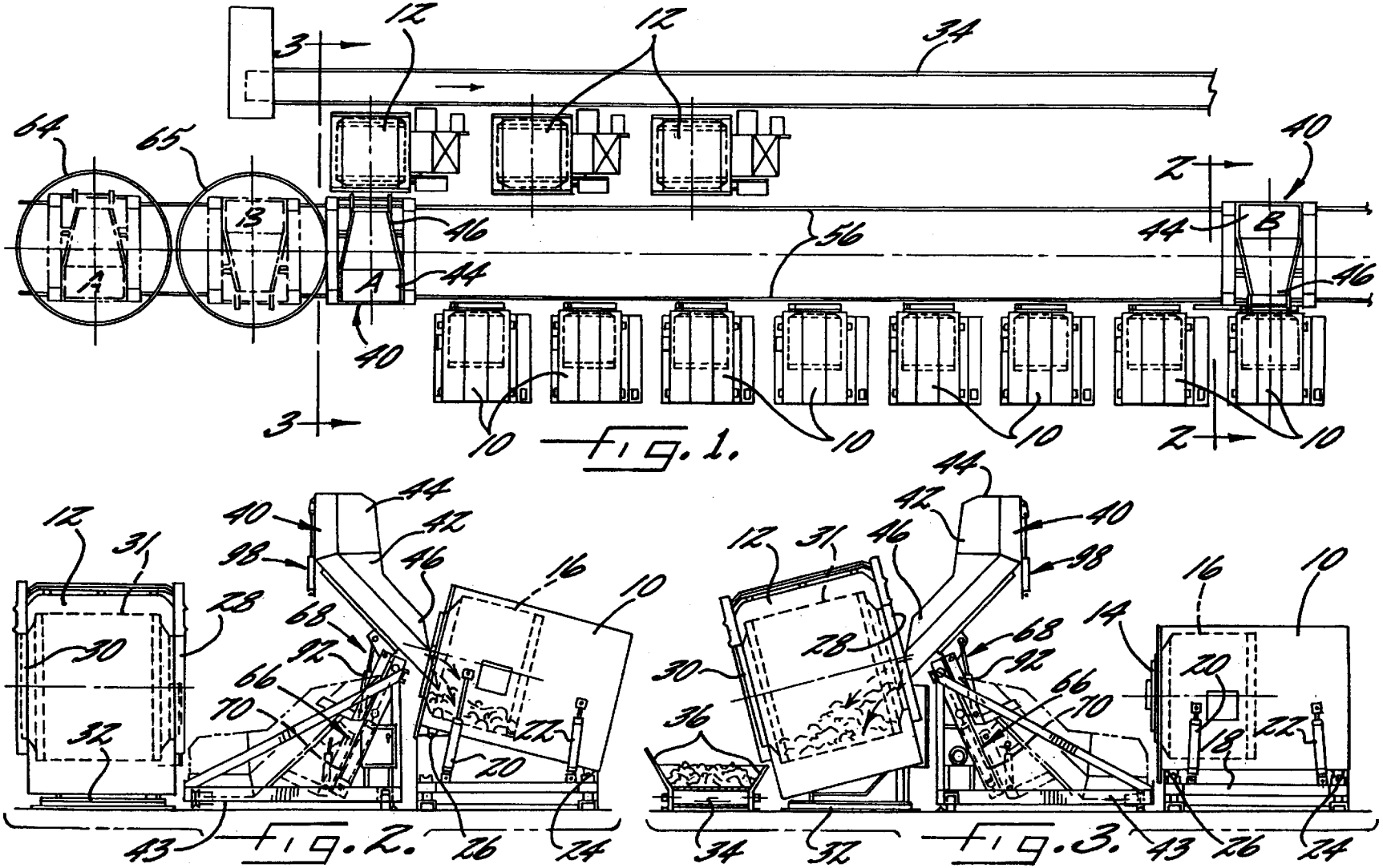
FIG. 1 is a plan view of an illustrative commercial laundry apparatus including a plurality of washing machines and dryers and utilizing a shuttle hopper loading and unloading system in accordance with the present invention.
FIG. 2 is a side view taken along the plane of line 2—2 in FIG. 1 showing one of the shuttle hoppers loading one of the washing machines of the illustrated commercial laundry apparatus.
FIG. 3 is a side view taken along the plane of line 3—3 in FIG. 1 showing one of the shuttle hoppers loading one of the dryers of the illustrated commercial laundry apparatus.

Referring now more particularly to FIG. 1 there is shown an illustrative commercial laundry apparatus embodying the present invention which includes a plurality of washing machines 10 and dryers 12. While the present invention is described in connection with a particular illustrated embodiment of a commercial laundry apparatus, it will be readily appreciated that the present invention is equally applicable to commercial laundry apparatus and facilities having different configurations and utilizing different types of equipment. In particular, the present invention can be utilized to increase the operating utilization and minimize the floor space requirements of any commercial laundry facility. The plurality of washing machines 10, or more particularly washer/extractors, are used to wash the soiled garments or other goods being laundered. Specifically, in the illustrated embodiment, eight washers 10, which may be of conventional type, are arranged in side-by-side relation so as to form a row as shown in FIG. 1. The front side of each washer 10 includes a door 14 which permits access to the interior of the washer for the loading and unloading operations. The interior of the washer 10 includes a perforated rotatable basket 16 within which the items to be cleaned are deposited. Preferably, the washer 10 and basket 16 have a 450 to 900 pound capacity.

Figure 16:
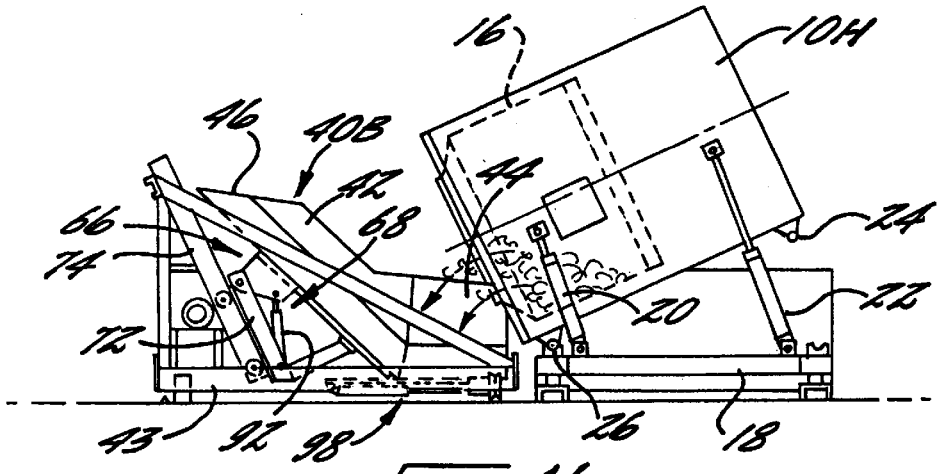
FIG. 16 is a side view taken in the plane of line 16—16 in FIG. 15 showing the washing machine discharging a wet load of cleaned items into shuttle hopper B.
Figure 17:
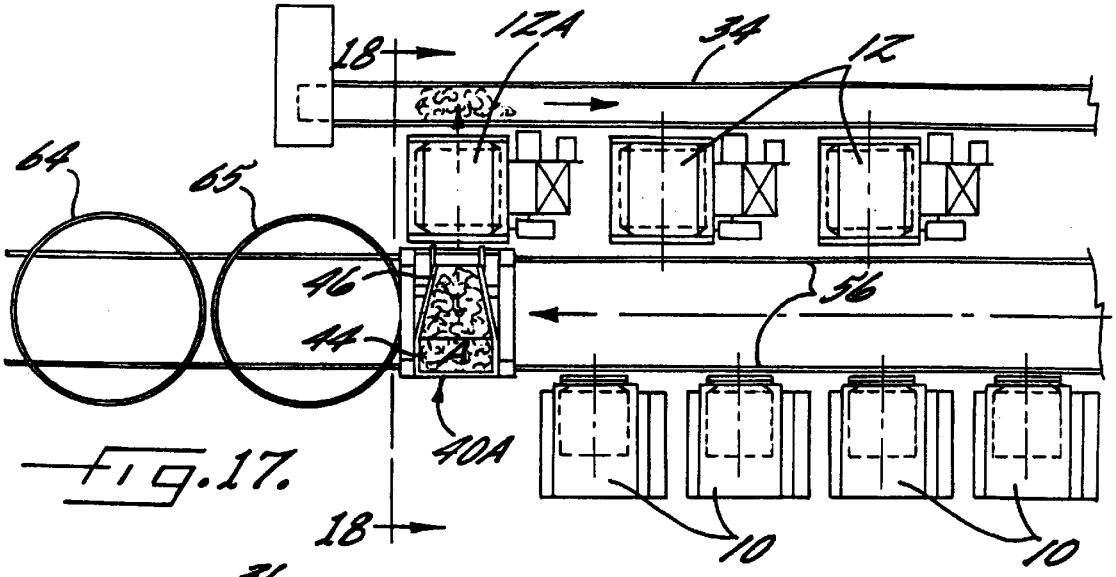
FIG. 17 is a partial plan view of the illustrative commercial laundry apparatus showing shuttle hopper A arranged in front a dryer.

In order to facilitate loading and unloading, each washer 10 is supported by a frame 18 which selectively tilts the washer both forwards and backwards. As shown in FIG. 2, the washer frame 18 includes a pair of front hydraulic tilt cylinders 20 and a pair of rear hydraulic tilt cylinders 22 which interconnect the washer frame and the washer 10. These tilt cylinders are positioned so as to be selectively operable to raise either the front or rear end of the washer 10. In particular, when the front tilt cylinders 20 are extended the washer 10 tilts back into a loading position about an axis defined by a pair of pivot pins 24 carried at the base of the rear end of the washer as shown in FIG. 2. Similarly, when the rear pair of lift cylinders 22 are extended, the washer 10 tilts forward into an unloading position about an axis defined by a pair of pivot pins 26 carried at the base of the front end of the washer as shown in FIG. 16.

For drying the items after they are washed, a plurality of dryers 12, which also may be of conventional type, are provided. As shown in FIG. 1, the illustrated laundry apparatus includes three dryers 12 which are arranged facing the washers 10 in a row substantially parallel to the row of washers. Large doors 28, 30 are provided in both the front and rear sides of each dryer 12 in order to permit easy access to an interior cylindrical drying basket 31 which preferably has a 450 to 900 pound capacity. As was the case with the washers 10, each dryer 12 is equipped with a frame 32 which can selectively tilt the dryer both forward and backward, for example up to 15°, so as to facilitate loading and unloading operations. Specifically, as shown in FIG. 3, the dryer 12 may be tilted back through appropriate actuation of tilt cylinders into a position wherein wet items can be loaded into the dryer through the front door 28 and/or dry items can be unloaded from the dryer through the rear door 30. Alternatively, if unloading through the front door 28 of the dryer is preferred, the dryer 12 may be tilted forward.

In order to carry away the dry items after they are unloaded through the rear door 30 of the dryer, a flat bed conveyor 34 is provided. As best shown in FIGS. 1 and 3, the flat bed conveyor 34 runs behind and parallel to the row of dryers 12 such that when the rear door 30 is opened and the dryer is tilted back, the dry items are discharged onto the conveyor 34. As shown in FIG. 3, the belt conveyor 34 is equipped with side rails 36 which help prevent items from falling off of the sides of the conveyor.

In accordance with an important aspect of the present invention, the illustrated commercial laundry system has a shuttle hopper system which includes at least one shuttle hopper which can be used to load or unload launderable items from either a washer or a dryer. In the illustrated embodiment, a pair of shuttle hoppers 40 are provided for loading and unloading the washers 10 and dryers 12. As shown in FIGS. 1–3, the shuttle hoppers 40 are interposed between the row of washers 10 and the row of dryers 12 and can be raised and rotated so as to load items into either a washer or a dryer. As will be appreciated, this shuttle hopper system loads and unloads items from both the washers and the dryers much more quickly than conventional loading and unloading methods and systems such as overhead slings and conveyor belts. As a result, the washing and drying machines are utilized much more efficiently enabling the laundry facility to operate at a higher capacity.

Figure 4:
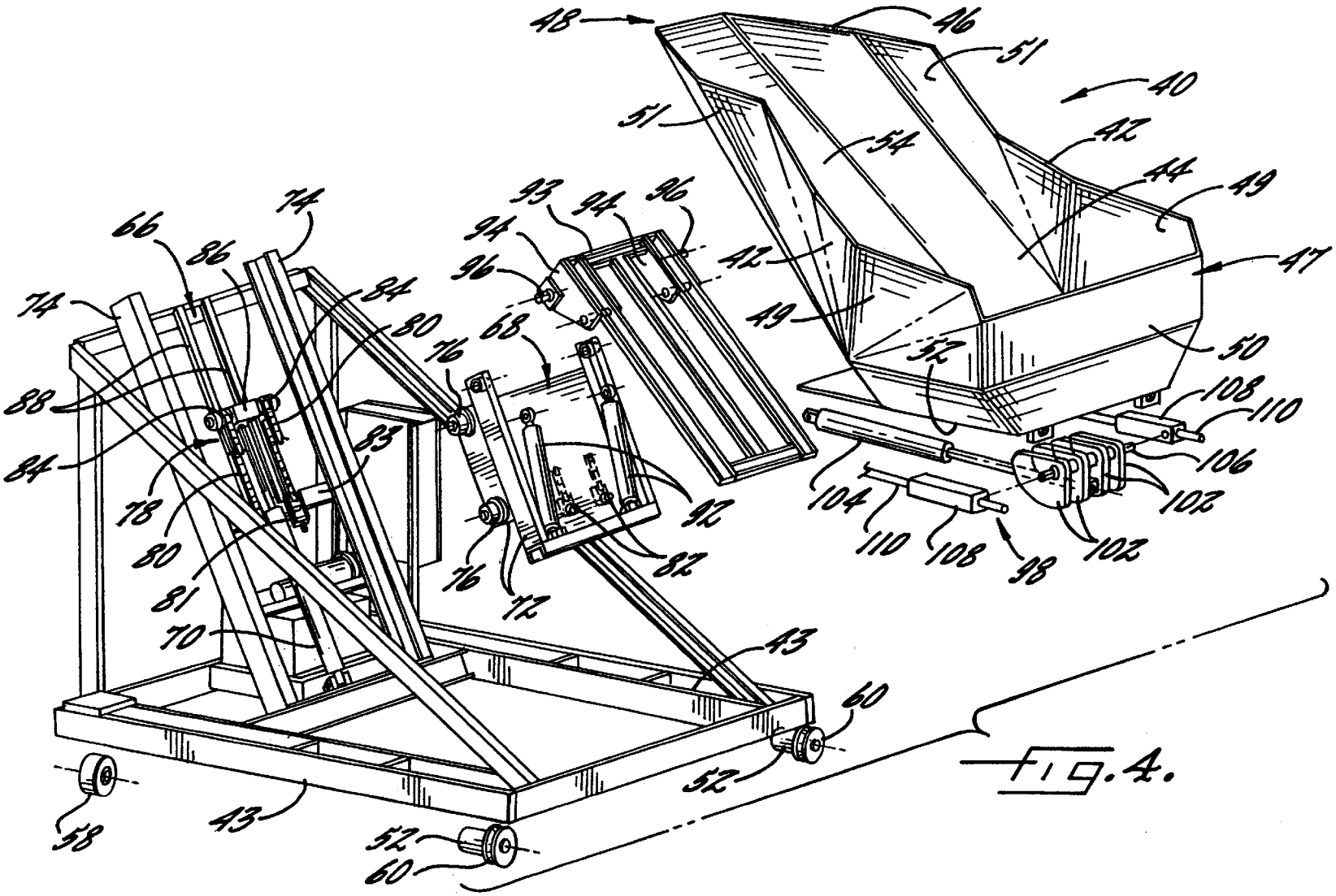
FIG. 4 is an exploded perspective view of one of the shuttle hoppers employed in the illustrated commercial laundry apparatus.

For receiving, holding and discharging items during the laundering process each shuttle hopper 40 includes a bucket 42 which defines an enclosure for receiving laundry items. As best shown in FIG. 4, the bucket 42 is supported by a shuttle frame 41 and includes a base section 44 and a funnel section 46. The base section 44 is primarily intended to receive and hold items being laundered, while the funnel section 46 helps guide and direct items as they are discharged from the bucket 42 into a washer or dryer. The base section 44 is arranged at a rear end 47 of the bucket and has a bottom wall 52, two upstanding side walls 49 and a rear wall 50 which also forms the rear wall of the bucket. The funnel section 46 has a bottom wall 54 which is inclined at an acute angle relative to the bottom wall 52 of the base section such that the funnel section feeds or "funnels" into the base section 44. Additionally, in order to help prevent items from spilling to the side of the shuttle hopper 40 as they are discharged from the base section 44 of the bucket, the funnel section 46 has a pair of side walls 51.

The shuttle bucket 42 has several advantages over conventional overhead slings and conveyor belts. For example, the shuttle bucket 42 can be configured to receive and hold loads of up to 900 pounds of laundry items which is four times the capacity of conventional overhead slings. Additionally, a belt conveyor which is capable of holding such a quantity of laundry items would require a much wider aisle (e.g., 18 feet) between the rows of washers and dryers than is required for the operation of a shuttle hopper having a bucket capable of handling such a load (e.g., approximately 10 feet in one preferred embodiment). Using a shuttle bucket to support the load of laundry items also eliminates the reliability and maintenance problems associated with carrying heavy loads on conveyors, rollers or slings. Moreover, the shuttle bucket 42 can be configured to be considerably wider than conventional conveyors thereby providing a larger area for receiving the laundry items. This helps prevent laundry items from spilling onto the floor as they are discharged from a washer.

Figure 5A:
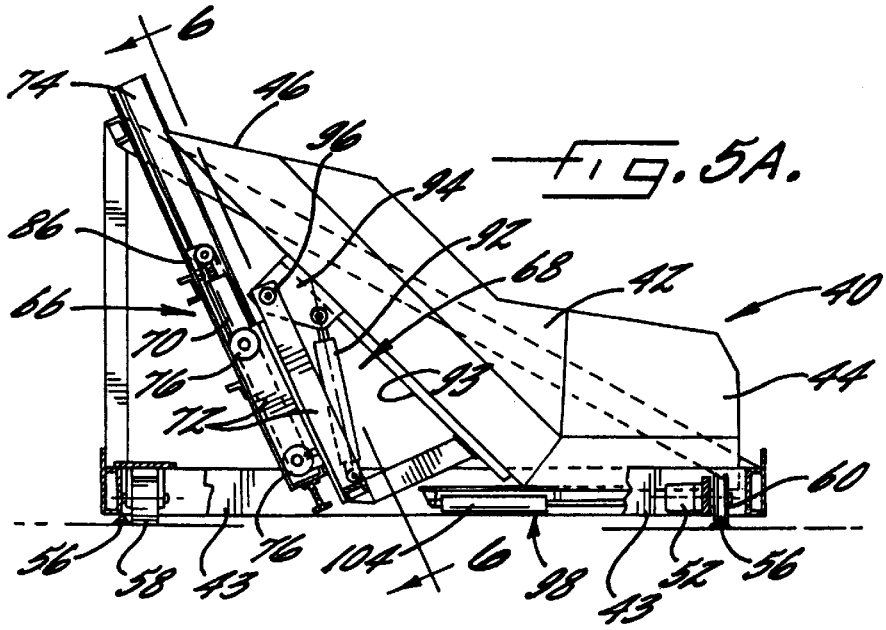
FIG. 5A is a partial side view of the illustrated shuttle hopper showing the shuttle bucket in the lowered transport position.
Figure 5B:
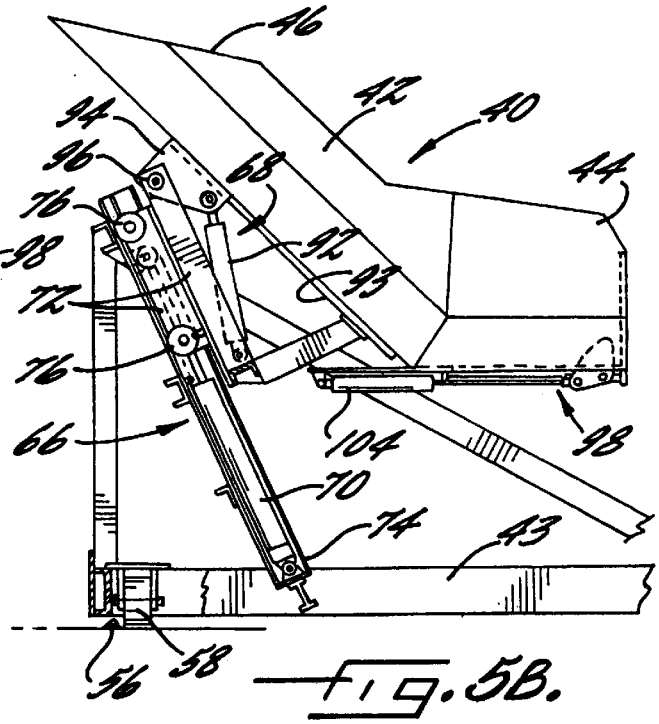
FIG. 5B is a partial side view of the illustrated shuttle hopper showing the shuttle bucket in the raised position.
Figure 5C:
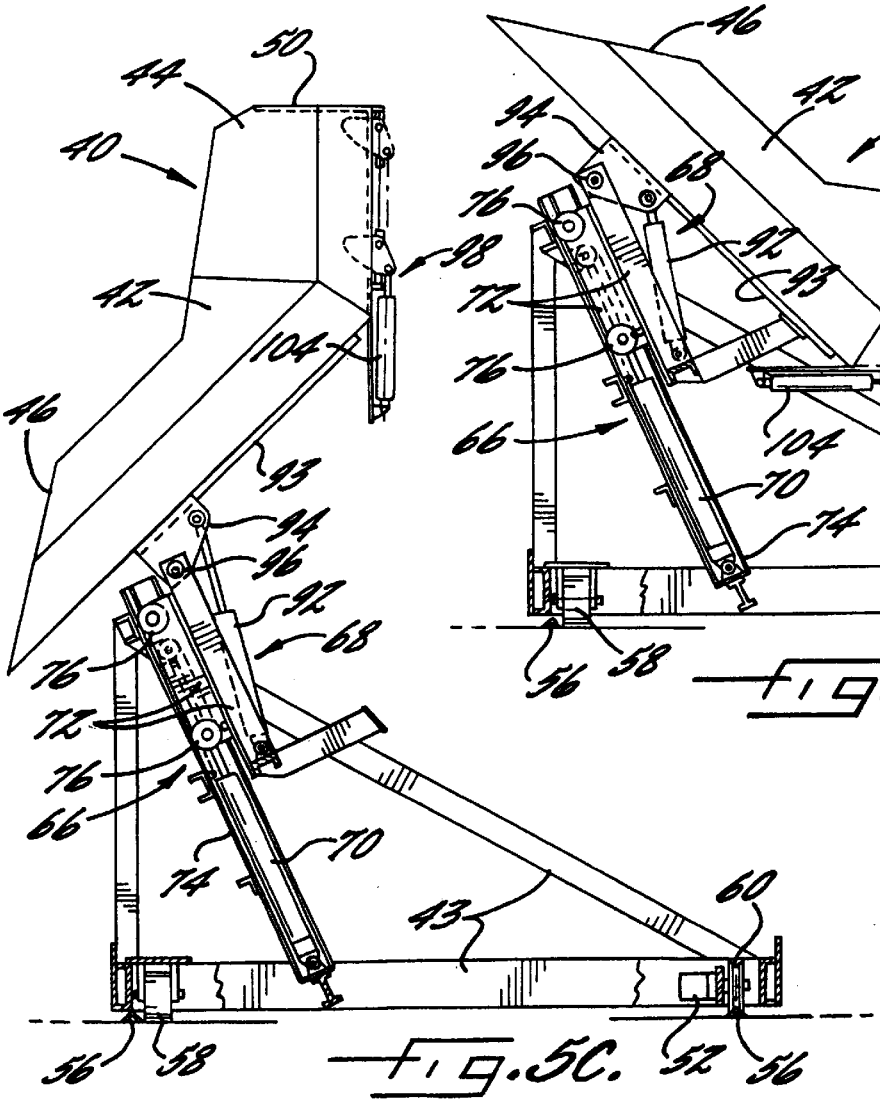
FIG. 5C is a side view of the illustrated shuttle hopper showing the shuttle bucket in the dump position.

In keeping with a further aspect of the present invention, the shuttle hoppers 40 include an assembly for raising and rotating the bucket 42 so as to allow items contained therein to be discharged into a washer 10 or a dryer 12. More specifically, as shown in FIGS. 2 and 3, the shuttle hoppers 40 include a lift assembly 66 and a tilt assembly 68 which move the shuttle bucket 42 between a lowered position (shown in broken lines) for transport and loading and a dumping position (shown in solid lines) for discharging items from the shuttle bucket 42 through the open front door of either a washer 10 (FIG. 2) or a dryer 12 (FIG. 3). The operating sequence of the lift and tilt assemblies 66, 68 is best understood through reference to FIGS. 5A–C. Specifically, to dump items from the shuttle hopper 40, the lift assembly 66 first operates to raise the shuttle bucket 42 from the lowered position, shown in FIG. 5A to an intermediate raised position shown in FIG. 5B. As the lift assembly 66 raises the bucket 42, it also moves the bucket laterally forward and thereby closer to the washer or dryer into which the items in the bucket are to be discharged. Once the shuttle bucket 42 reaches the intermediate raised position, the tilt assembly 68 can be actuated so as to rotate the bucket into the dump position as shown in FIG. 5C. Prior to the rotation of the shuttle bucket 42 into the dump position, the washer 10 or dryer 12 being loaded is tilted back such that it is ready to receive items from the hopper. As will be appreciated, once the dumping operation is completed, the bucket 42 can be returned to the lowered position for subsequent transport or reloading by first operating the tilt assembly 68 to rotate the shuttle bucket 42 back into the intermediate position and then lowering the bucket through operation of the lift assembly 66. Preferably, the shuttle hopper 40 is configured and positioned relative to the washers and dryers such that when the shuttle bucket 42 is in the dumping position a portion of the funnel section 46 extends into the open front door of either the washer 10 or dryer 12 as shown in FIGS. 2 and 3. This helps to ensure that items are not spilled when they are being loaded into the washers or dryers.

Figure 8:
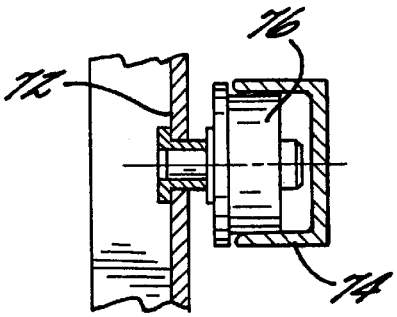
FIG. 8 is a partial section view taken in the plane of line 8—8 in FIG. 7 showing the tilt carrier guide rails.

For moving the shuttle bucket 42 between the lowered position and the intermediate position, the lift assembly 66 includes a lift cylinder 70. The lift cylinder 70, which preferably is hydraulic, is mounted on the shuttle frame 43 and is operable to raise and lower a tilt carrier frame 72 which, in turn, carries the shuttle bucket 42 along a pair of guide rails 74. As best shown in FIGS. 4 and 5A–C, both the lift cylinder 70 and the tilt carrier guide rails 74 are arranged at an angle somewhat less than vertical in order to enable the shuttle bucket to move forwardly as it is raised. The tilt carrier frame 72, in this case, includes four wheels 76 or pulleys which ride in the guide rails 74 as shown in FIG. 8.

Figure 6:
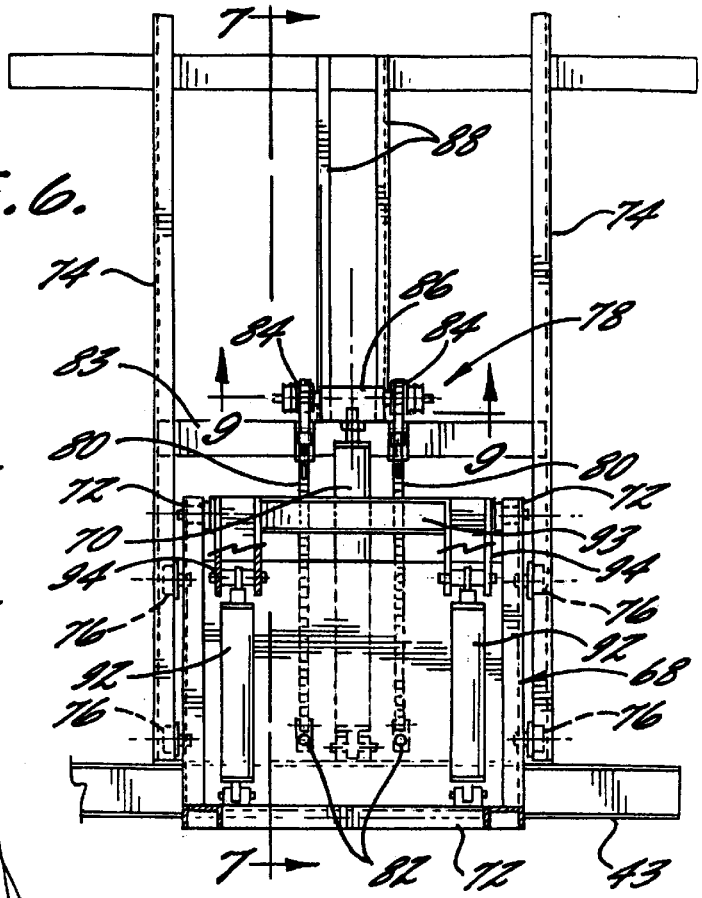
FIG. 6 is a partial section view taken in the plane of line 6—6 in FIG. 5A showing the tilt carrier of the illustrated shuttle hopper.
Figure 7:
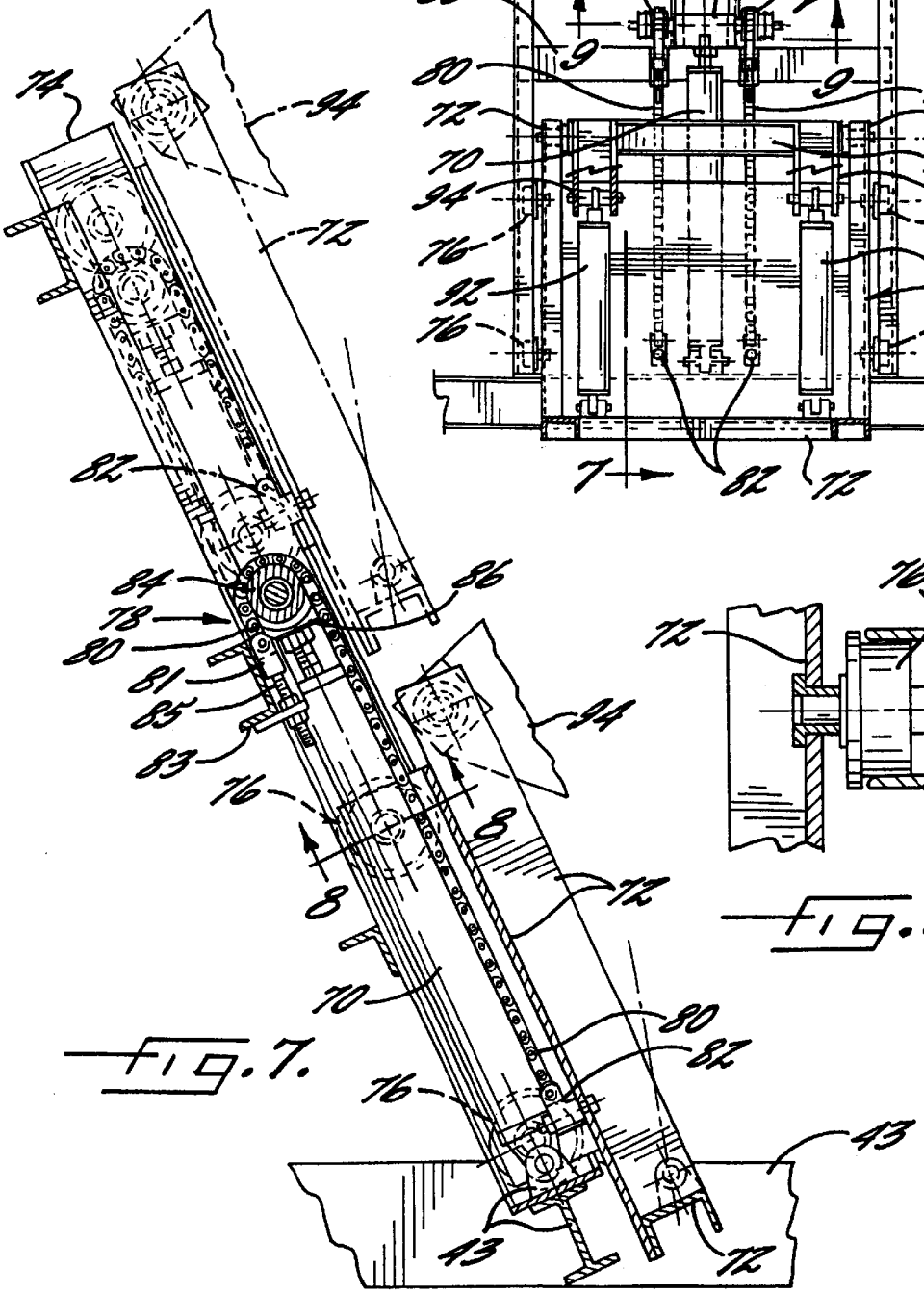
FIG. 7 is a partial section view taken in the plane of line 7—7 in FIG. 8 showing the tilt carrier of the illustrated shuttle hopper.
Figure 9:
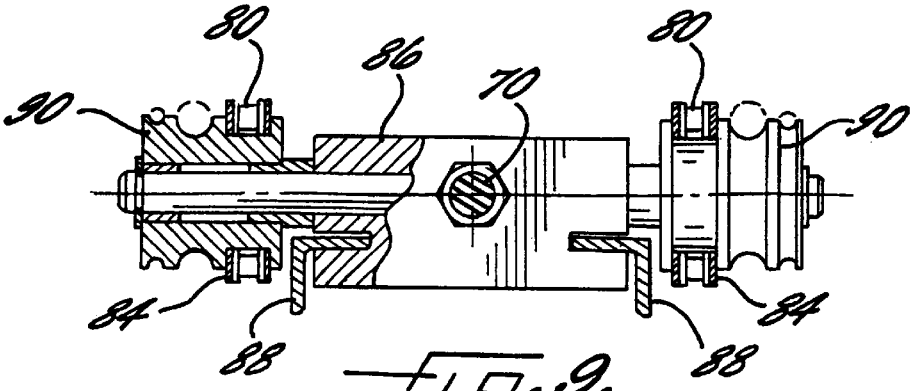
FIG. 9 is partial section view taken in the plane of line 9—9 in FIG. 6 showing the tilt carrier pulley block.

In order to ensure that the tilt carrier frame 72 slides smoothly without becoming cocked at an angle with respect to the guide rails 74, the lift cylinder 70 acts on the tilt carrier 72 through a chain pulley 78. As shown in FIGS. 4, 6 and 7, the chain pulley 78 includes a pair of chains 80 each of which has one end connected to the shuttle frame 43 via a first anchor 81 and an opposing end connected to the tilt carrier frame 72 via a second anchor 82. In the illustrated embodiment, the anchor 81 for the end of the chain connected to the shuttle frame 43 is attached to a horizontal cross-member 83 extending between the two guide rails 74. Preferably, the anchor for at least one end of each chain 80 is adjustable to allow for selective adjustment of any slack in the chains. Specifically, in the illustrated embodiment, the anchor 81 is connected to the cross-member 83 by a screw mounting 85 (FIG. 7) which can be used to selectively adjust the position of the anchor 81 relative to the cross member 83 and thereby adjust any slack in the chain. Each chain 80 is further disposed about a respective one of a pair of pulleys 84 which are rotatably supported by a pulley block 86 as best shown in FIGS. 7 and 9. The pulley block 86 is adapted for sliding movement along a pair of pulley block guide rails 88 which extend parallel to the tilt carrier guide rails 74 in response to actuation of the lift cylinder 70. In particular, as shown in FIGS. 6–7, the lift cylinder 70 is mounted with one end attached to the shuttle frame 43 and an opposing end attached to the pulley block 86 such that extension and retraction of the lift cylinder 70 causes the pulley block to move between lowered (shown in solid lines in FIG. 7) and raised positions (shown in broken lines in FIG. 7) along its guide rails 88 as the tilt carrier moves between its lowered and intermediate positions. As the pulley block 86 is raised and lowered, the chains 80 roll over the pulleys 84 and provide more reliable guiding of the tilt carrier 72. In addition to the two pulleys 84, the pulley block 88 also carries guides 90, shown in FIG. 9, for the electrical wire and hydraulic hoses associated with operation of the tilt carrier 72 and the lift assembly 66.

Figure 10:
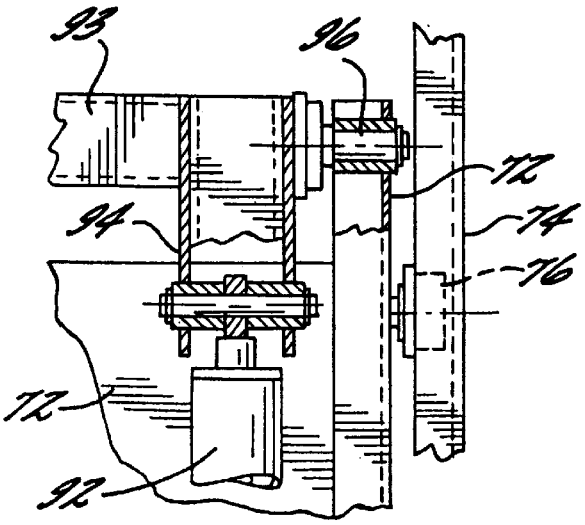
FIG. 10 is an enlarged partial view of the connection between the tilt carrier, one of the tilt cylinders and the bucket frame.

For rotating the shuttle bucket 42 between the intermediate raised position and the dump position, a pair of tilt cylinders 92 are provided. As best shown in FIG. 4, the tilt cylinders 92, which are preferably hydraulic, are laterally spaced from each other and are arranged on the tilt carrier 72 such that they move with the tilt carrier in response to actuation of the lift cylinder 70. Each tilt cylinder 92 has a first end pivotally connected to the tilt carrier frame 72 and a second end pivotally connected to a frame 93 which underlies and helps support the shuttle bucket 42. As shown in FIGS. 4 and 10, the lift cylinders 92 are pivotally connected to the tilt carrier 72 via a pair of mounting brackets 94 carried by the bucket frame 93. The bucket frame 93, in turn, is pivotally mounted on the tilt carrier frame 72 via a pair of laterally spaced pivot pins 96 which engage the tilt carrier frame adjacent the upper end thereof such that the shuttle bucket 42 is rotatable relative to the tilt carrier frame about an axis defined by the two pivot pins 96 in response to actuation of the tilt cylinders 92. Thus, once the shuttle bucket 42 has been raised to the intermediate position, the tilt cylinders 92 are actuated to rotate the shuttle bucket between the intermediate and dumping positions as shown in FIGS. 5B–C and thereby discharge the items in the shuttle bucket into the washer or dryer.

Figure 11:
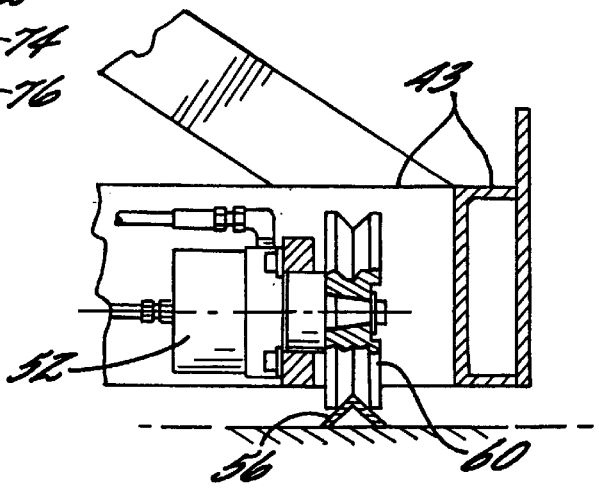
FIG. 11 is an enlarged partial view of one of the drive wheels of the illustrated shuttle hopper.
Figure 12:
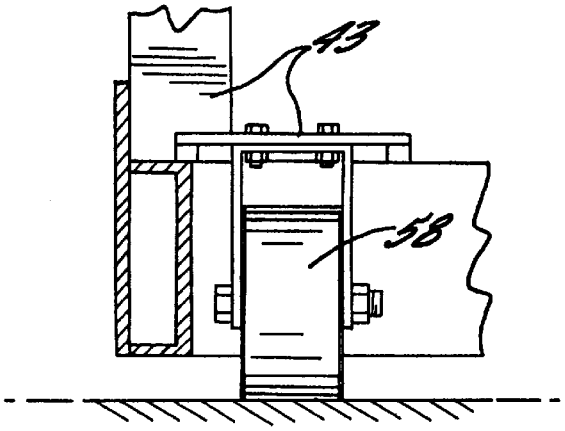
FIG. 12 is an enlarged partial view of one of the support wheels of the illustrated shuttle hopper.

In accordance with a further important aspect of the present invention, the shuttle hoppers are selectively movable such that they can be positioned in front of any of the various washers 10 and dryers 12. In this manner, the shuttle hoppers 40 can be used to load or unload any of the individual washers or dryers. As will be appreciated by those skilled in the art, this movement of the shuttle hoppers facilitates automation of the loading and unloading of a plurality of washing and drying machines thereby enabling the equipment to operate even more efficiently both in terms of laundering capacity and operating cost. For effecting movement of the shuttle hoppers, each shuttle hopper 40 includes a pair of support wheels 58 and a pair of drive wheels 60. As best shown in FIGS. 4 and 5, the pair of support wheels 58 are rotatably mounted on one side of the shuttle frame 43 while the pair of drive wheels 60 are rotatably mounted on the opposing side of the shuttle frame 43. To guide the movement of the shuttle hoppers 40, a pair of parallel guide tracks 56 are provided. As best shown in FIG. 1, the guide tracks 56 are arranged parallel to and interposed between the rows of washers and dryers. In the illustrated embodiment, each guide track 56 has an inverted v-shaped configuration and the circumferential surface of the drive wheels 60 include a complementary v-shaped groove which allows the drive wheels to engage and ride over one of the guide tracks 56 as shown in FIG. 11. Each drive wheel 60 is driven by an associated motor 62 which is also mounted on the shuttle frame 43 adjacent the respective drive wheel. In order to enable faster movement of the shuttle hoppers 40, the drive motors 62 are preferably hydraulic although it will be appreciated that other types of motors including electric may also be used. Unlike the drive wheels 60, the support wheels 58 do not normally engage the guide tracks 56 (see, e.g. FIG. 5A), but instead have a generally smooth surface which is adapted to engage the ground as shown in FIG. 12.

In order to enable the shuttle hoppers 40 to be used to load either the washers 10 or the dryers 12, a mechanism for rotating the shuttle hoppers is provided. In particular, since in the illustrated laundry apparatus the washers 10 and dryers 12 are arranged facing each other in two rows, the shuttle hoppers 40 are rotatable such that their funnel sections 46 can face either the washers 10 or the dryers 12. To effect such rotation, a pair of turntables 64, 65 are provided each of which is assigned to a respective one of the shuttle hoppers 40. As shown in FIG. 1, the turntables 64, 65 are arranged at one end of the aisle between the washers and the dryers. The guide tracks 56 extend across the turntables 64, 65 such that the shuttle hoppers 40 can be moved into a position on top of the turntables as desired. Once in position on one of the turntables 64, 65, the shuttle hopper 40 can be rotated through the operation of the turntable. Thus, the turntables enable the direction in which the funnel section 46 of the shuttle hopper faces to be selectively changed thereby allowing the shuttle hopper 40 to switch between loading washers 10 and loading dryers 12. It will be appreciated that other mechanisms for rotating the shuttle hoppers 40 could also be used including incorporating the rotation mechanism directly into the frame 43 of the individual shuttle hoppers 40. Moreover, the shuttle hoppers may have a guide track system which eliminates the need for rotating the shuttle hoppers or the washers and dryers may be arranged in a manner, such as in a single row, which eliminates the need for a hopper rotation mechanism.

In accordance with another aspect of the present invention, a pulling fin assembly 98 may be provided in each shuttle hopper 40 in order to assist the loading and unloading operation. As shown in FIGS. 13A–D, the pulling fin assembly 98 can be used to selectively deploy a plurality of pulling fins 102 into the shuttle bucket 42 enclosure. Once deployed, the pulling fins 102 can be used to move items contained within the shuttle bucket 42. In the illustrated embodiment, the pulling fins 102 can be selectively deployed into the base section 44 of the shuttle bucket so as to move items contained therein. It will be appreciated, however, that a substantially identical pulling fin assembly may be provided for the funnel section 46 in order to help move items in that section of the shuttle bucket. In addition, those skilled in the art will appreciate that other methods may be employed for moving and distributing items within the shuttle bucket including, for example belts and chains. If a mechanism is not provided for distributing the items, manual assistance may be required.

The pulling fin assembly 98 generally includes a plurality of pulling fins 102 which are actuated by a hydraulic cylinder 104. As shown in FIG. 4, in the illustrated embodiment, four laterally spaced pulling fins 102 are attached to a rod 106 which extends substantially across the width of the shuttle bucket. The rod 106 is pivotally connected at its opposite ends to respective shuttle blocks 108. The shuttle blocks 108 are adapted for sliding movement along a pair of guide rods 110 which are arranged below the bottom wall 52 of the base section of the shuttle bucket. The guide rods 110 are generally parallel to the bottom wall 52 of the base section and extend generally from the rear wall 50 of the shuttle bucket to the funnel section 46 of the shuttle bucket as shown in FIGS. 13A–D. The hydraulic cylinder 104 is also arranged beneath the shuttle bucket 42 and is pivotally connected at one end to the shuttle bucket 42 and at the opposing end to at least one of the pulling fins 102.

Figure 13A:
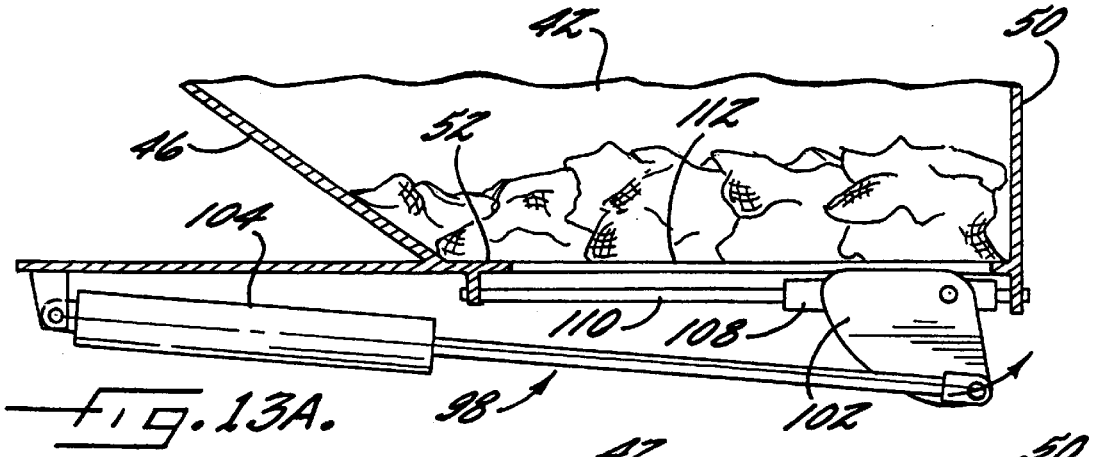
FIG. 13A is an enlarged partial side view of the illustrated shuttle hopper showing the pulling fin assembly with the pulling fins in the disengaged and extended position.
Figure 13B:
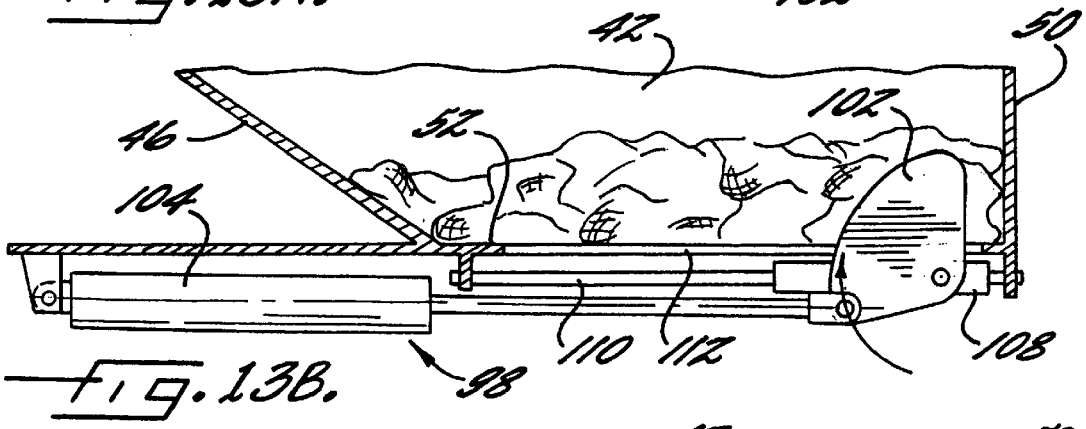
FIG. 13B is an enlarged partial side view of the illustrated shuttle hopper showing the pulling fin assembly with the pulling fins in the engaged and extended position.
Figure 13C:
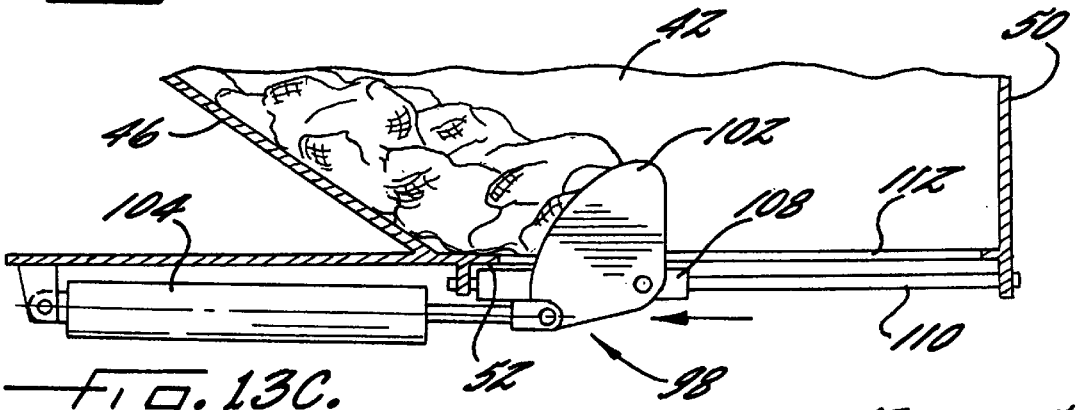
FIG. 13C is an enlarged partial side view of the illustrated shuttle hopper showing the pulling fin assembly with the pulling fins in the engaged and retracted position.
Figure 13D:
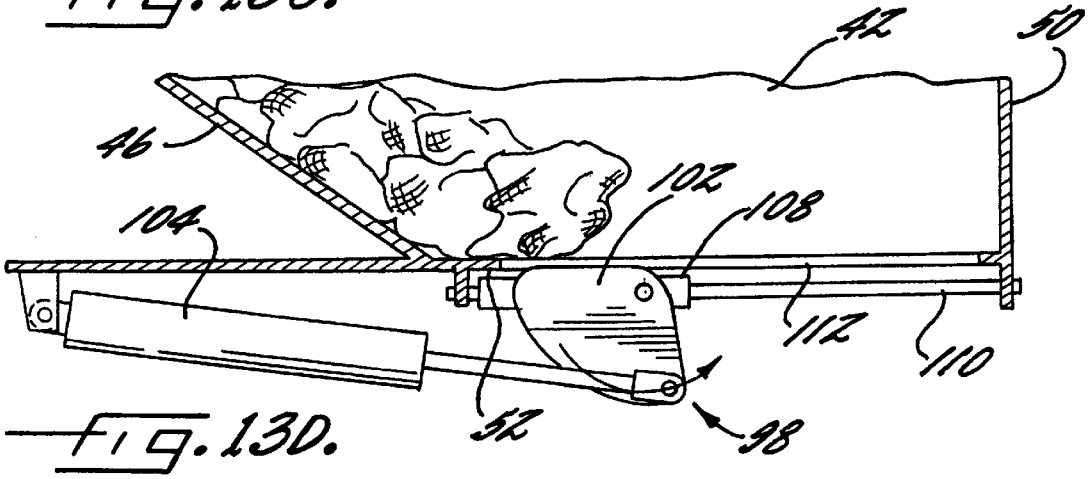
FIG. 13D is an enlarged partial side view of the illustrated shuttle hopper showing the pulling fin assembly with the pulling fins in the disengaged and retracted position.

Actuation of the hydraulic cylinder 104 moves the pulling fins 102 between withdrawn and deployed positions and extended and retracted positions. In particular, the operating sequence of the pulling fin assembly 98 is best understood with reference to FIGS. 13A–D which illustrate how the pulling fins 102 can operate to pull or move items away from the rear wall 50 and towards the funnel section 46 of the shuttle hopper. The operating sequence of the pulling fin assembly begins with the cylinder 104 extended and the pulling fins 102 in the fully extended and withdrawn position as shown in FIG. 13A. In the fully extended position, the pulling fins are disposed adjacent the rear wall 50 of the shuttle hopper. Additionally, when the pulling fins 102 are in the withdrawn position, they are disposed outside of the shuttle bucket 42 enclosure, beneath the bottom wall 52 of the base section. As shown in FIG. 13B, the initial retraction of the cylinder 104 pivots the pulling fins 102 in a clockwise direction (with reference to FIGS. 13A–D) into the deployed position. In the deployed position, a substantial portion of each pulling fin 104 extends upward through a respective slot 112 provided in the bottom wall 52 of the shuttle bucket and into the shuttle bucket enclosure. As will be appreciated, once the pulling fins 104 reach the deployed position, a stop prevents further rotation of the pulling fins. Further retraction of the cylinder 104, causes the pulling fins 102 to move via the shuttle blocks 108 along the guide rods 110 from the extended position (FIGS. 13A and 13B) to the retracted position (FIGS. 13C and 13D). As the pulling fins 102 move from the extended to retracted positions, they engage the items in the shuttle bucket 42 and pull or drag them away from the rear wall 50 towards the funnel section 46. Moving the items away from the rear wall 50 of the shuttle bucket 42 helps distribute the load in the shuttle bucket thereby ensuring that a full load of items from a washer 10 can be discharged into the shuttle hopper 40. Otherwise, it is possible that the items being unloaded from the washer could stack up and block further discharge of items from the washer 10 or cause items to spill.

Once the pulling fins reach the retracted position adjacent the funnel section, as shown in FIG. 13C, the cylinder may then be extended to withdraw the pulling fins 102 from the shuttle bucket 42. Specifically, the initial extension of the cylinder 104 pivots the pulling fins 104 counterclockwise back to the withdrawn position as shown in FIG. 13C. As with deployment of the pulling fins, a stop is provided which prevents further rotation of the pulling fins 102 once they reach the withdrawn position. Further extension of the cylinder 104, slides the now withdrawn pulling fins 102 along the guide rails 110 back towards the rear of the shuttle bucket and into the fully extended position of FIG. 13A. The operation may then be repeated as desired to continue to move items being loaded from a washer into the shuttle hopper away from the rear end of the shuttle bucket 42. To assist the unloading of the shuttle bucket, a substantially similar pulling fin assembly may be provided for the funnel section 46 of the shuttle bucket which would operate to pull items towards the top of the funnel section. For example, when the shuttle bucket 42 is raised to discharge wet items into a dryer 12 as shown in FIG. 3, the pulling fins in the funnel section would operate to help pull the wet items down the funnel section and into the dryer.

Figure 15:
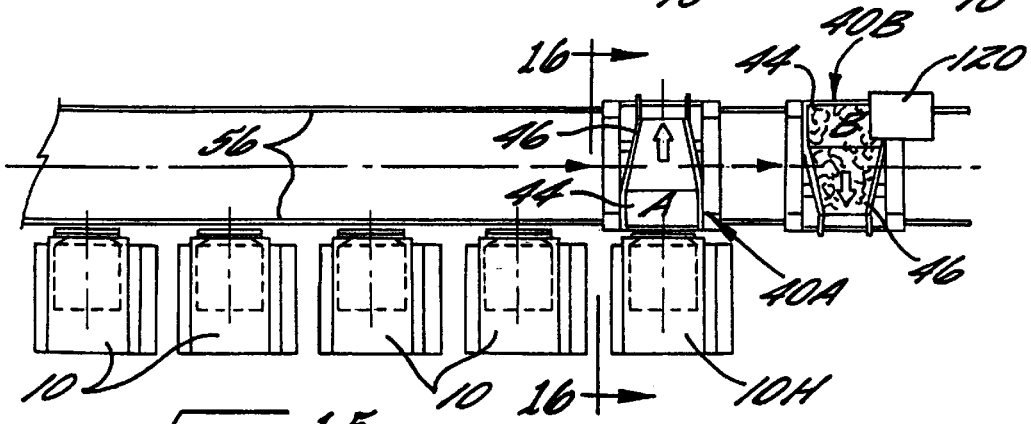
FIG. 15 is a partial plan view of the illustrative commercial laundry apparatus showing shuttle hopper A arranged in front of one of the washing machines and shuttle hopper B in a docking position.

In order to further ease the loading of the washers 10 and to provide further operational efficiency, the laundry system may be equipped with a wet loading system which may be used to wet soiled laundry items contained in the shuttle bucket 42 before they are discharged into a washer 10. One manner in which the pre-wetting of the items could be carried out is to provide a pre-wetting station 120 for the shuttle hoppers 40 as shown in FIG. 15. The pre-wetting station 120 would be equipped with a liquid supply system which could be used to selectively discharge water and other laundry chemicals onto the soiled items in the bucket 42 of the shuttle hopper 40. Alternatively, the water and laundry chemicals could be inserted into the shuttle bucket 42 before the laundry items are loaded into the shuttle hopper. As shown in FIG. 15, the pre-wetting station 120 can be located at a home or docking position along the rail system 56 such that the shuttle hoppers 40 would be moved or indexed to the pre-wetting station 120 via the rail system prior to being used to load a washer 10. Of course, if a pre-wetting system is provided the shuttle bucket 42 should be substantially liquid tight. In the illustrated embodiment, this can be accomplished either by eliminating the pulling fin assembly 98 or by sealing the openings in the bottom wall 52 of the base section 44 of the bucket. As will be appreciated, wetting the soiled items in the bucket 42 before they are loaded into the washer 10 helps reduce the amount of time which the washer must spend wetting down the items thereby speeding up the operating cycle of the washers 10. In addition, pre-wetting the soiled clothes in the shuttle hopper 40 also facilitates the loading of the items into the washer 10. A dry load of soiled items can be difficult for an automated operation to handle because of its lightweight, large size, high friction and tendency to tangle. Pre-wetting the items in the shuttle hopper, however, adds weight to the load, compacts it and allows it to slide much more easily.

In accordance with yet another important aspect of the present invention, the shuttle hoppers 40 may be operated in tandem to quickly unload clean items from a washer 10, transfer the clean items to a dryer 12 and reload the washer. An illustrative operating sequence of the pair of shuttle hoppers 40 is best understood through reference to FIGS. 14–22. For ease of reference, in connection with the description of the operating sequence, the two shuttle hoppers are referenced as 40A and 40B. The loading/unloading sequence begins when one of the washers 10 completes its wash cycle. As explained above, each of the shuttle hoppers 40A, B is capable of performing at least the following three functions: (1) load dirty clothes into a washer 10, (2) receive clean, wet clothes from a washer 10 and (3) load clean, wet clothes into a dryer 12. During the loading/unloading sequence, one shuttle hopper is responsible for receiving the clean wet items from the washer 10 and loading them into a dryer 12 while the other shuttle hopper is responsible for reloading dirty items into the washer. As will be appreciated from the following description, the particular role or function that each of the shuttle hoppers 40A, B performs during the loading/unloading sequence depends on the position of the washer 10 which has completed its wash cycle relative to the position of the dryer 12 which will be used to dry the now clean items from that washer. The movement of shuttle hoppers 40A, B during the loading/unloading sequence can be controlled through a control system which, for example, could include a programmable logic controller (PLC) associated with each shuttle hopper and a master controller which communicates with the shuttle hopper PLCs. Alternatively, the shuttle hopper PLCs could be eliminated and the loading/unloading operation could be controlled through a single master controller.

Figure 14:
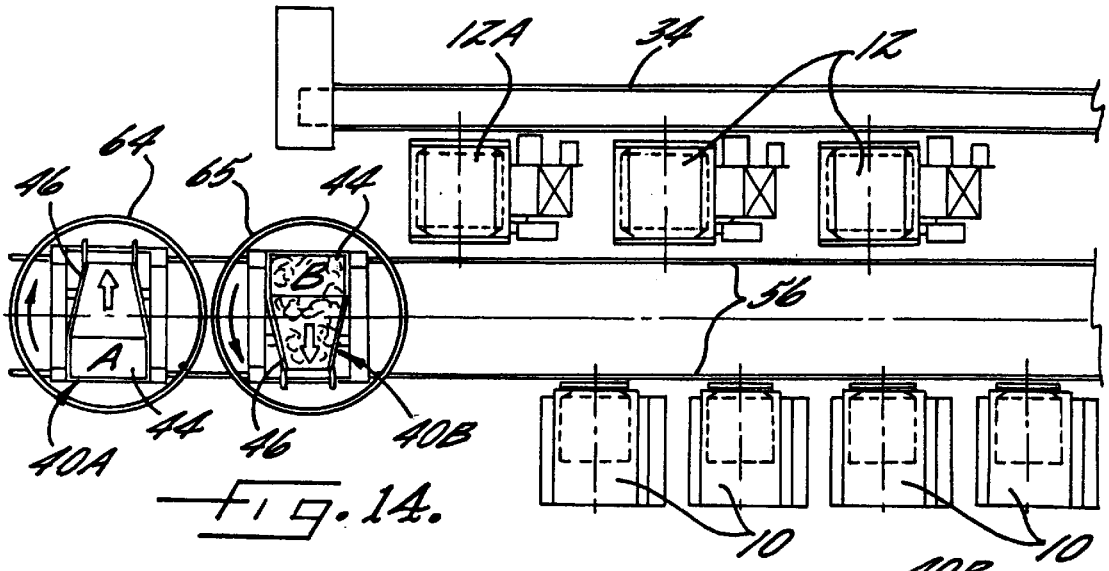
FIG. 14 is a partial plan view of the illustrative commercial laundry apparatus showing shuttle hoppers A and B arranged on the rotating tables after being positioned for an exemplary loading and unloading operation.

Referring now more particularly to FIG. 14, the shuttle hoppers 40A and 40B are shown positioned on their respective turntables 64, 65 for initiation of an loading/unloading sequence wherein clean, wet items from a washer will be loaded into a dryer positioned to the left of the washer (with reference to the plan view of FIGS. 14, 15, 17, 20 and 22). Shuttle hopper 40A has been rotated such that its funnel section 46 faces the row of dryers. Shuttle hopper 40A is empty, and is ready to receive a load of items from one of the washers 10. In contrast, shuttle hopper 40B has been rotated such that its funnel section 46 faces the row of washers and thus is in position to load one of the washers. As shown in FIG. 14, the bucket 42 of shuttle hopper 40B has been filled with soiled laundry items. The soiled items can be loaded into shuttle hopper 40B by any known means including by hand or via slings which are provided on an overhead monorail system. Since the washers typically have a 450 pound capacity, it is preferable to load 450 pounds of soiled items into the shuttle hopper. This generally requires the use of two overhead slings as they typically only have a maximum capacity of 225 pounds. Next, shuttle hopper 40A is moved along the guide tracks 56 into position in front of the washer which has completed its wash cycle, which in the illustrated example is the washer (referenced as 10H) at the right end of the row of washers. Simultaneously, shuttle hopper 40B moves into a docking position to the right of washer 10H.

Figure 18:
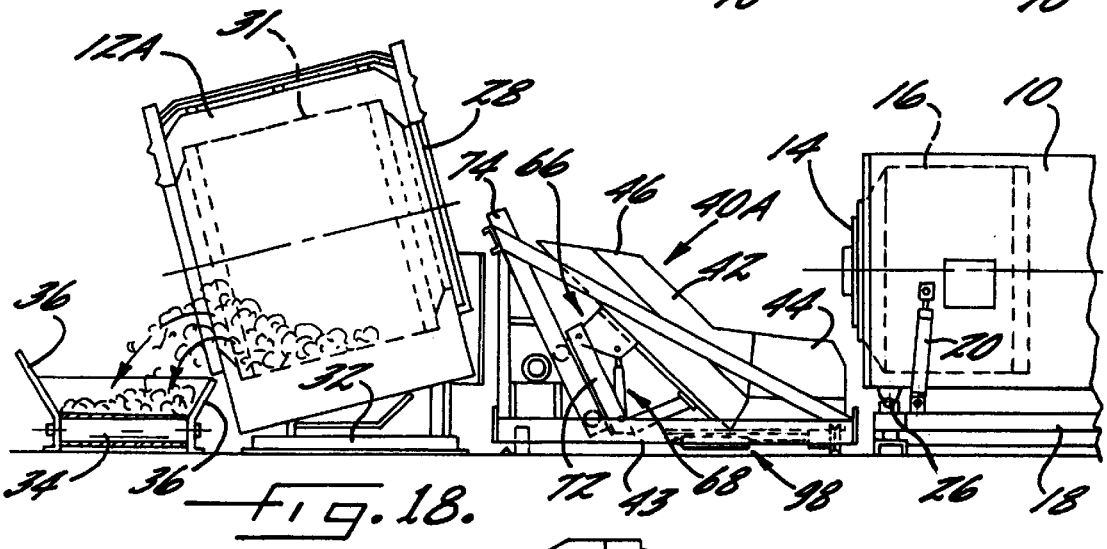
FIG. 18 is a side view taken in the plane of line 18—18 in FIG. 17 showing the dryer discharging a dry load onto a conveyor.
Figure 19:
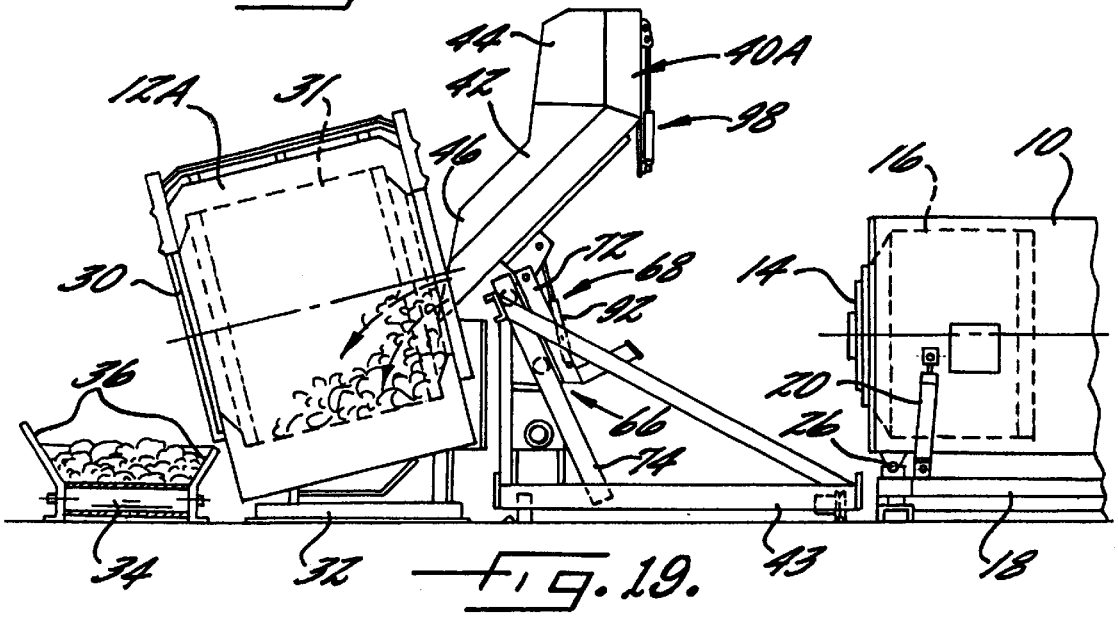
FIG. 19 is a side view showing shuttle hopper A discharging the wet load into the dryer.

In order to unload the clean wet items from the washer 10H, the washer is tiled forward about pivot pins 26 via operation of the rear tilt cylinders 22 once the shuttle hopper 40B is in position in front of the washer 10H as shown in FIG. 16. The items within the washer may then drop into the shuttle hopper 40A. As the items are discharged into the shuttle hopper 40A, the pulling fins 102 are deployed into the base section and operate to pull the load away from the washer 10H allowing the entire load to be discharged into the shuttle hopper. As the clean items are unloaded into the shuttle hopper 40A, the perforated washer basket 16 is rotated in both directions so as to facilitate the discharge of items from the washer. Optionally, as the items as being discharged the from the washer, the shuttle bucket may be moved left and right of the centered position in front of the washer in order to help spread the load in the bucket. Once all of the items from the washer 10H have been discharged into the bucket 42, the shuttle hopper 40A is then moved via the guide tracks 56 into position in front of the dryer which will be used to dry the wet load. In the illustrated example, the dryer (referenced as 12A) positioned closest the turntables 64, 65 will be used to dry the items, however, it will be appreciated that any of the three dryers in the illustrated embodiment could be used. Prior to loading the wet items into the dryer 12A, the dryer is tilted back and the rear door 30 is opened to discharge the load of previously dried items from the dryer onto the flat-bed conveyor 34 as shown in FIG. 18. The previously dried items are then carried away by the flat-bed conveyor 34 for further processing such, for example, as pressing or folding. After the load of dried items has been discharged, the dryer 12A remains tilted back, however, the rear door 30 of the dryer is closed and the front door 28 is opened so that the dryer can receive the new load of wet items from the shuttle hopper 40A.

In order to discharge the items in the shuttle hopper 40A into the dryer 12A, the bucket 42 is raised to the intermediate position via the lift assembly 66 and then rotated via the tilt assembly 68 into the dump position as described above and shown in FIG. 19. As the wet items are being loaded into the dryer 12A, the dryer basket 31 is rotating to help pull the load from the shuttle bucket 42. In addition, if a pulling assembly is provided for the funnel section 46, the pulling fins are deployed into the funnel section and are operating to pull the load towards the dryer door opening. Once the entire load has been discharged into the dryer 12A, the lift and tilt assemblies 66, 68 return the shuttle bucket 42 to the lowered position for transport back to its associated turntable 64 where it can be positioned for the next operation as shown in FIG. 20.

Figure 20:
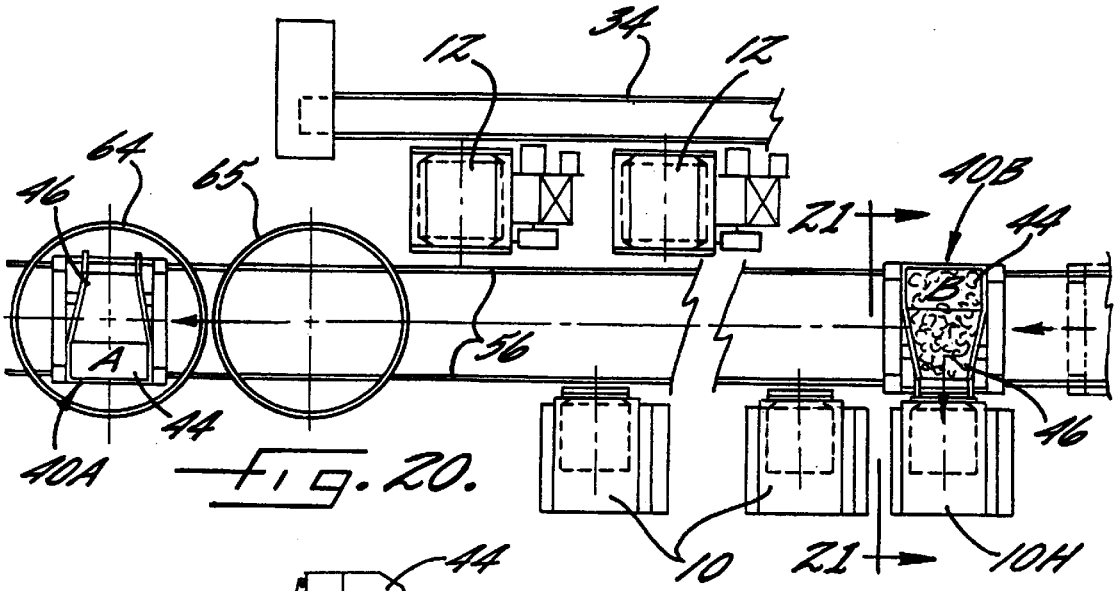
FIG. 20 is a partial plan view of the illustrative commercial laundry apparatus showing shuttle hopper A back on one of the rotating tables and shuttle hopper B positioned in front of one of the washing machines.
Figure 21:
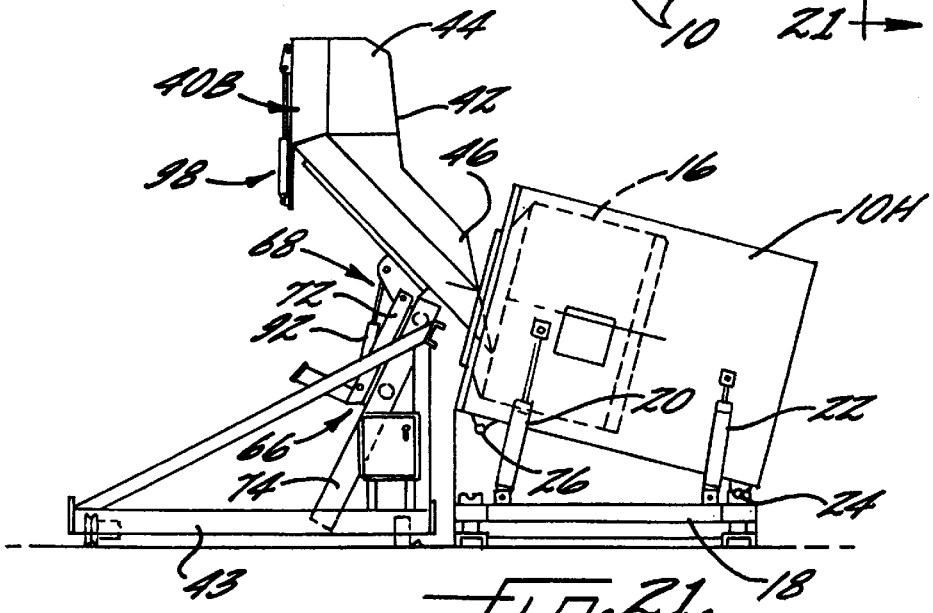
FIG. 21 is a side view taken along the plane of line 21—21 in FIG. 20 showing shuttle hopper B discharging a load of dirty items into the washing machine.
Figure 22:
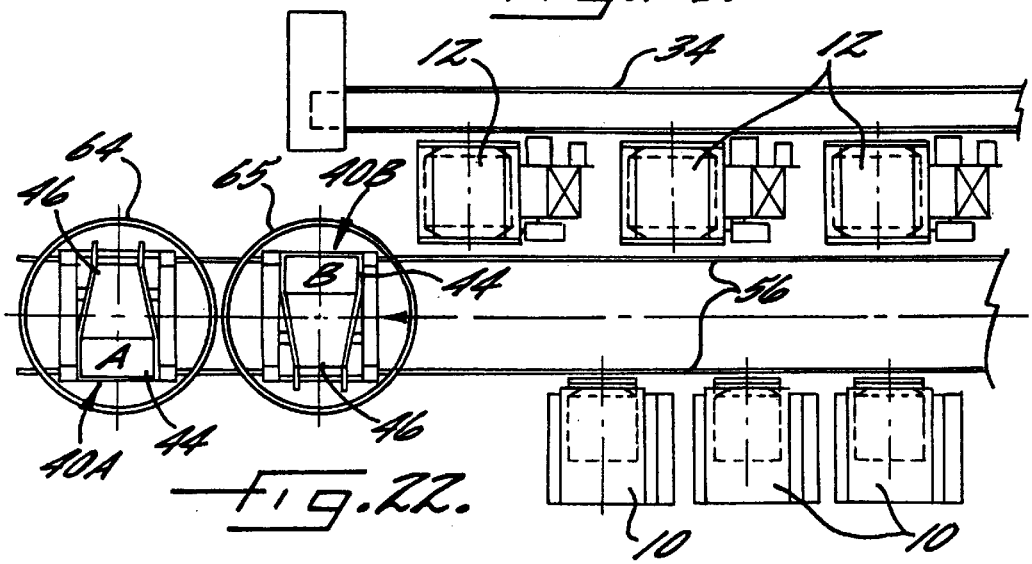
FIG. 22 is a partial plan view of the illustrative commercial laundry apparatus showing both hopper shuttles after they have returned to the rotating tables for repositioning.

During the dryer loading sequence, shuttle hopper 40B moves into position in front of the now empty washer 10H in order to reload the washer (also shown in FIG. 20). As shown in FIG. 21, the washer 10H tilts back about its rear pivot pins 24 as result of operation of the front tilt cylinders 20 in preparation for receiving the new load of soiled laundry items. The bucket 42 of shuttle hopper 40B is then raised and rotated into the dumping position through operation of the lift and tilt assemblies 66, 68 in order to discharge the laundry items into the washer 10H. As the laundry items are being discharged into the washer 10H, the washer basket 16 is rotating to help pull the load into the washer and any pulling fins provided in the funnel section are deployed and operating to pull the load toward the washer door opening. Once all of the items are discharged into the washer 10H, the bucket 42 is returned to the lowered position and the shuttle hopper 40B is then moved to its associated turntable 65 for positioning for the next operation. It will be appreciated that instead of providing a second shuttle hopper, the washer may be reloaded through conventional means such as by hand or via overhead slings.

While the loading/unloading operation has been described in connection with transferring wet items from a washer to a dryer arranged to the left of the washer, those skilled in the art will appreciate that if wet items are transferred to a dryer to the right of the washer, the roles of the two shuttle hoppers are simply reversed. In particular, shuttle hopper 40A is responsible for reloading soiled laundry items into the washer while shuttle hopper 40B is responsible for receiving the cleaned wet items from the washer and loading them into the appropriate dryer.

From the foregoing it can be seen that the shuttle hopper loading/unloading system of the present invention enables commercial washers and dryers to be loaded and unloaded significantly faster than the systems and methods which are presently used. Thus, the washers and dryers are utilized much more efficiently. Additionally, the shuttle hopper system is more reliable both mechanically and in handling the laundry items (i.e., no spilling or jamming of loads). The shuttle hopper system can also be used to automate the loading and unloading of the washers and dryers thereby reducing operating costs.

What is claimed is:

1. A method for unloading laundered items from a washer and transferring them to a dryer with a shuttle hopper, said shuttle hopper being selectively movable between the washer and the dryer and including a bucket for receiving and holding launderable items, said bucket being movable between lowered and raised positions and rotatable between said raised position and a dump position, the method comprising the steps of:

moving said shuttle hopper into position in front of said washer, tilting said washer forward to discharge the laundered items from the washer into said shuttle bucket, moving said shuttle hopper into position in front of said dryer, tilting said dryer back, lifting said bucket into said raised position through operation of a lift assembly carried by said shuttle hopper, and rotating said bucket into said dump position through operation of a tilt assembly carried by said shuttle hopper so as to discharge said laundered items from said bucket into said dryer.

2. The method of claim 1 further including the steps of moving a second shuttle hopper having a bucket filled with soiled laundry items into position in front of said washer, lifting said bucket of said second shuttle hopper into the raised position through operation of a lift assembly carried by the second shuttle hopper, and rotating said bucket of said second shuttle hopper into a dump position through operation of a tilt assembly carried by said second shuttle hopper so as to discharge the dirty laundry items from the bucket into the washer.

* * * * *